US006903318B2

(12) United States Patent
Thorneywork

(10) Patent No.: US 6,903,318 B2
(45) Date of Patent: Jun. 7, 2005

(54) PROGRAMMABLE FOOD SERVICE SYSTEMS AND METHOD

(75) Inventor: Nigel Thorneywork, Surrey (GB)

(73) Assignee: Merrychef Limited, Hampshire (GB)

( * ) Notice: Subject to any disclaimer, the term of this patent is extended or adjusted under 35 U.S.C. 154(b) by 0 days.

(21) Appl. No.: 10/354,436

(22) Filed: Jan. 28, 2003

(65) Prior Publication Data

US 2003/0141296 A1 Jul. 31, 2003

Related U.S. Application Data

(63) Continuation-in-part of application No. 09/797,457, filed on Mar. 1, 2001, now Pat. No. 6,660,982.

(51) Int. Cl.[7] ..... H05B 6/66

(52) U.S. Cl. ..... 219/702; 219/714; 219/492; 235/375; 700/90; 902/22

(58) Field of Search ..... 219/714, 492, 219/702; 235/375; 700/90; 902/22

(56) References Cited

U.S. PATENT DOCUMENTS

| | | | | |
|---|---|---|---|---|
| 3,569,656 A | | 3/1971 | White | 219/10.55 |
| 4,345,132 A | * | 8/1982 | Takase et al. | 219/714 |
| 4,841,125 A | | 6/1989 | Edamura | 219/506 |
| 5,245,329 A | | 9/1993 | Gokcebay | 340/825.31 |

FOREIGN PATENT DOCUMENTS

| | | |
|---|---|---|
| DE | 29 00 627 | 1/1980 |
| DE | 94 00 564 | 4/1994 |
| DE | 43 17 624 | 6/1994 |
| GB | 2 318 884 | 5/1998 |
| WO | WO 02/23952 | 3/2002 |

OTHER PUBLICATIONS

International Search Report dated Nov. 8, 2001.
Mobbs, Dave, Examiner. United Kingdom Search Report Application No. GB0022378.4.
International Search Report from corresponding PCT/IB2004/000791 dated Aug. 25, 2004.

* cited by examiner

*Primary Examiner*—Shawntina Fuqua
(74) *Attorney, Agent, or Firm*—Ohlandt, Greeley, Ruggiero & Perle, L.L.P.

(57) ABSTRACT

A programmable food service system including one or more food service devices and at least one data key. Each data key is provided with a data memory for storing program data corresponding to sequences of food service operations. Each food service device includes a programmable controller for controlling the food service device to carry out sequences of cooking operations. Each food service device includes a key aperture adapted to receive a data key and a data reader arranged to read program data from the data key memory. The program data is passed on to the programmable controller, thereby making the appropriate sequences of cooking operations available to the food service device.

20 Claims, 10 Drawing Sheets

| | | | Time | Temperature | Power | | |
|---|---|---|---|---|---|---|---|
| B1 | P1 | S1 | xxxx | xxxx | xxxx | TYPE A OVEN | Microwave Combi |
| | | S2 | | | | | |
| | | S3 | | | | | |
| | P2 | S1 | | | | | |
| | | S2 | | | | | |
| | | S3 | | | | | |
| | P3 | S1 | | | | | |
| | | S2 | | | | | |
| | | S3 | | | | | |
| B2 | P1 | S1 | xxxx | | xxxx | TYPE B OVEN | Microwave |
| | | S2 | | | | | |
| | | S3 | | | | | |
| | P2 | S1 | | | | | |
| | | S2 | | | | | |
| | | S3 | | | | | |
| | P3 | S1 | | | | | |
| | | S2 | | | | | |
| | | S3 | | | | | |
| B3 | P1 | S1 | xxxx | xxxx | | TYPE C OVEN | Convection |
| | P2 | | | | | | |
| | P3 | | | | | | |
| B4 | P1 | | | | | TYPE D OVEN | Steam Combi |
| | P2 | | | | | | |
| | P3 | | | | | | |
| B5 | P1 | | | | | | Hob |
| | P2 | | | | | | |
| | P3 | | | | | | |

FIG.4

MC = Merrychef Ltd.

PROGRAMMABLE FOOD SERVICE SYSTEMS AND METHOD

This application is a continuation-in-part of U.S. application Ser. No. 09/797,457, filed on Mar. 1, 2001, now U.S. Pat. No. 6,660,982, which claims the benefit of Patent Application No. 0022378.4 filed in Great Britain on Sep. 13, 2000.

FIELD OF THE INVENTION

This invention relates to programmable food service systems and methods of operating programmable food service systems. A food service system may include an oven, a fryer, a grill, a food service display, an ice maker, a food warmer, a food chiller, a ventilating system and the like. For example, one embodiment of the invention is concerned with programmable food cooking systems comprising one or more microwave or combination ovens.

BACKGROUND OF THE INVENTION

In recent years, food service devices have been made programmable to afford the user a number of different operating modes. This gives the user flexibility to use the food service system in a way that is customized to the usage of the food service system at the user site. For example, a food service display may need one mix of display trays for breakfast and a different mix of display trays for lunch and dinner. The programmability feature allows the breakfast trays and tray bins to be easily converted from the heating and chilling needs of the breakfast serving to those of the lunch serving. As another example, the temperature and time profiles of a programmable fryer can be altered to suit a different range of food products.

In the catering industry there is increasingly a need to be able to deliver a given range of meals from a menu at maximum speed and efficiency. In order to achieve this, it is common to use pre-programmed cooking devices, such as microwave ovens, which are loaded with program data representing an optimized cooking sequence for each item on the menu.

For example, a combination oven (being an oven which can make use of a combination of microwave and conventional heating) may contain a cooking sequence for a given item on the menu, which comprises three stages, namely a defrosting stage, a microwave cooking stage, and finally a browning stage using conventional heating.

It will be appreciated that the cooking sequences must be carefully tailored to the particular oven being used, and the item to be cooked must match certain criteria (relating to the size and positioning of the food etc) which are specified in advance. In order to avoid the need for the chef to manually program each cooking sequence into each oven, ovens are known which allow the chef to select each cooking sequence at the push of a button, or by entering a number corresponding to that cooking sequence.

For example, an oven is made by Merrychef Ltd and sold under the name "Mealstream", which allows 10 different cooking sequences to be selected by simply pressing one of 10 different numbered buttons corresponding to the desired cooking sequence.

However, a problem can arise when it is required to change a menu for a different menu, as may happen on different days during the week, or at different times during the same day. In addition it may be necessary to update menus to reflect items added or deleted from a given menu.

In this regard it should be appreciated that the cooking sequences are usually determined at a different site (referred to herein as a data site) from the site at which the ovens are used (referred to herein as the cooking site), and there may be a number of cooking sites serviced by a single data site.

In order to address this problem, it is known to update the program data for an oven using a modem connection to the oven, which allows data to be delivered from the data site to the cooking site. It is also known from U.S. Pat. No. 4,841,125 to use separate ROM modules, which can be inserted into the oven in order to update the program data. Such ROM modules could for example be dispatched by post from the data site to the cooking site.

However, further problems can arise if the cooking site is relatively large and comprises an array of different cooking devices, such as microwave ovens, combination ovens, conventional ovens, steam combination ovens (using a combination of steam and conventional heating), and hobs. All of these cooking devices can be programmable, and all can be provided with program data representing a number of different cooking sequences corresponding to different items on a menu.

Modem solutions can be costly because it is necessary to supply each cooking device with a modem. Furthermore, because the data is sent from a remote site, the chef may lose some control over exactly which updates are made and exactly when these updates are made.

If ROM modules are used, the system can become complex to operate because it is necessary to supply a different module for each cooking device, and it is necessary for the chef to insert different modules into each cooking device each time it is required to change or update menus. As a result of this complexity errors can arise.

The invention seeks to overcome at least some of the disadvantages of the prior art.

SUMMARY OF THE INVENTION

Food service apparatus according to the present invention includes at least one food service device that comprises a key aperture adapted to receive a key. The key includes a memory that contains one or more programs. A key reader is disposed to access key memory. A controller is operatively linked to the key reader and responds to one of the programs to operate the food service device. Preferably, the controller is operable to control the key reader to write operating data of the food service device to the key memory. The controller preferably downloads the programs for operation of the food service device.

The key and the key reader each include communication contacts selected from the group consisting of: electrical, optical, infrared, magnetic and any combination thereof.

The food service device may be an oven, a fryer, a food service display, an ice maker, a grill, a ventilation system, or any other food service device. For an oven embodiment, the oven may be a convection oven, a microwave oven, a steam oven or any combination thereof.

In one embodiment, the programs are for different operating sequences of the food service device. In another embodiment, different ones of the programs exclusively operate different food service devices.

In another embodiment, the controller responds to the program to operate the food service device only when the key is inserted in the key aperture.

In another embodiment, a plurality of keys each carrying different program data, are provided. This allows a user to choose which operational sequences to make available to the food service device, and to make different cooking sequences available at different times.

In another embodiment, different data keys are different colours, in order to provide more simple identification to a user.

A method according to the present invention operates a food service device by providing a key aperture in the food service device. A key that carries a memory containing a program is inserted into the key aperture. The program is used to operate the food service device.

In another embodiment of the method, a data writer of the food service device writes to the key memory operational data relating to the operation of the food service device.

In another embodiment of the method, the operational data includes data representing the total time for which the food service device has been used since a given point in time. The total time data, for example, may be analyzed in order to provide usage information, and said usage information is used to determine whether the food service device falls within the terms of a warranty on the food service device provided by a supplier to the food service device user.

According to another embodiment of the method of the present invention, a plurality of carrier devices is provided. Each carrier device has a memory that stores a program. The program of each carrier device is different from that of the other carrier devices. Each carrier device is given a different colour according to a plan of operating the food service device. The carrier devices are inserted in a reader disposed in the food service device to operate the food service device with the different programs according to the plan.

The carrier devices are selected from the group consisting of: key, card, and any combination thereof.

In another embodiment, the colours correspond to different times. The food service device is operated according to the plan when the carrier devices are inserted into the reader at the different times corresponding to the colours.

Another embodiment of the method of the present invention provides operational programs to a food service device. The operational programs are stored in a first memory. The programs are downloaded to a second memory located on a key that is adapted for insertion in a key aperture disposed in the food service device.

BRIEF DESCRIPTION OF THE DRAWINGS

Embodiments of the invention will now be described, by way of example only, with reference to the accompanying drawings, in which:

FIG. 4 shows the arrangement of blocks of memory on the data key;

DESCRIPTION OF THE PREFERRED EMBODIMENT

Figure 1:
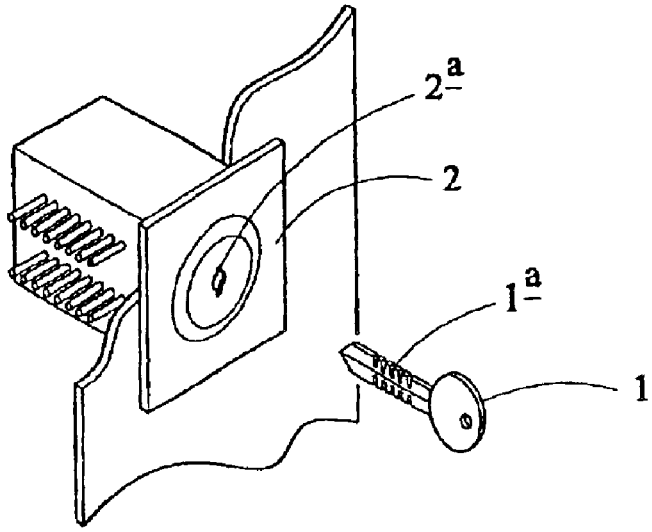
FIG. 1 shows a data key and key aperture for use with the embodiments described.

FIG. 1 shows a data key 1 (for example Serial Memory Token LCK 16000 manufactured by Datakey, Inc. of 407 West Travellers Trail, Burnnsville, Minn. 55337, USA) and a data key reader 2. The reader 2 is provided with a key aperture 2*a* adapted to receive the key 1 in order to allow data to be passed to and from the key 1. The key 1 is provided with a suitable memory, such as an $E^2$PROM (electrically erasable programmable ROM) for storing data, and with a number of contacts 1*a* for communicating with the reader 2. Contacts 1*a* may be electrical, magnetic, optical, infrared or any combination thereof.

Figure 8:
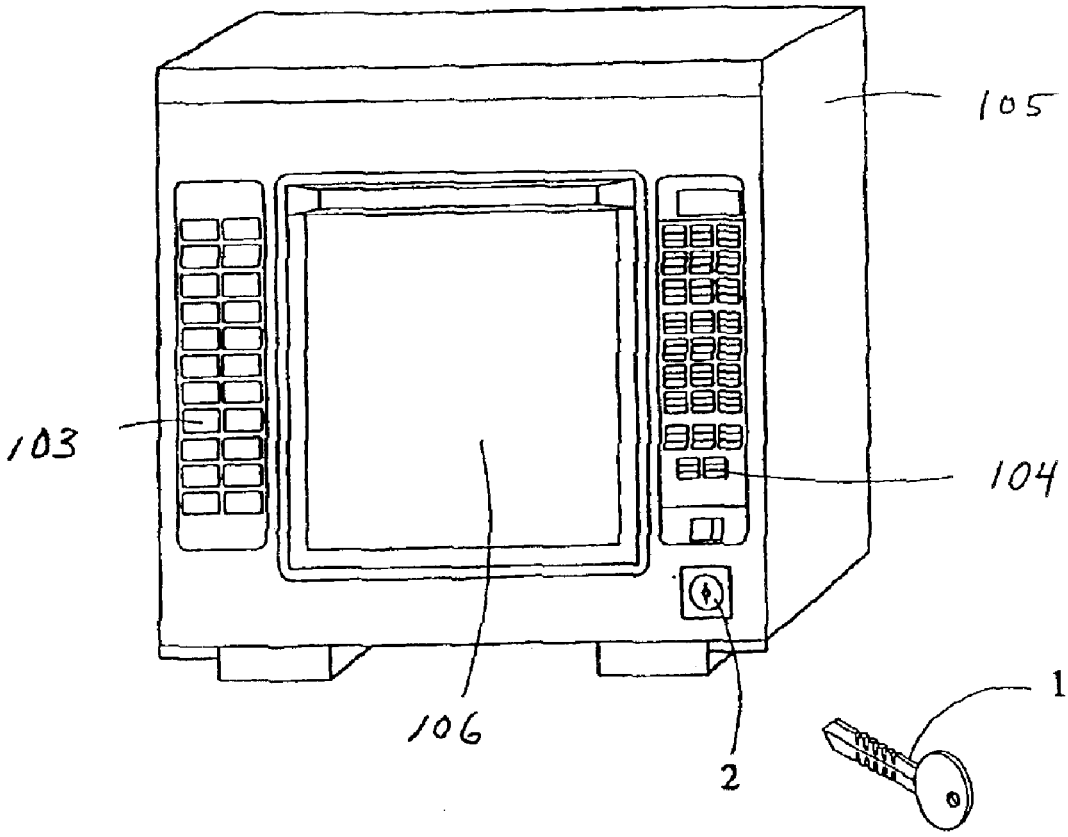
FIG. 8 shows a food service device provided with the key reader of FIG. 1.

Referring to FIG. 8, a programmable food service device 105 includes key reader 2 and key aperture 2*a*. Key aperture 2*a* is preferably disposed in a user accessible location, such as an external panel or other suitable location. Food service device 105 also includes one or more keypads for entry of data or switch selection for control of food service device 105. A panel 106 is disposed to provide user access to a food service area of food service device 105. For example, panel 106 may be a door to an oven, an ice bin, a food warmer, a food chiller and the like.

Figure 9:
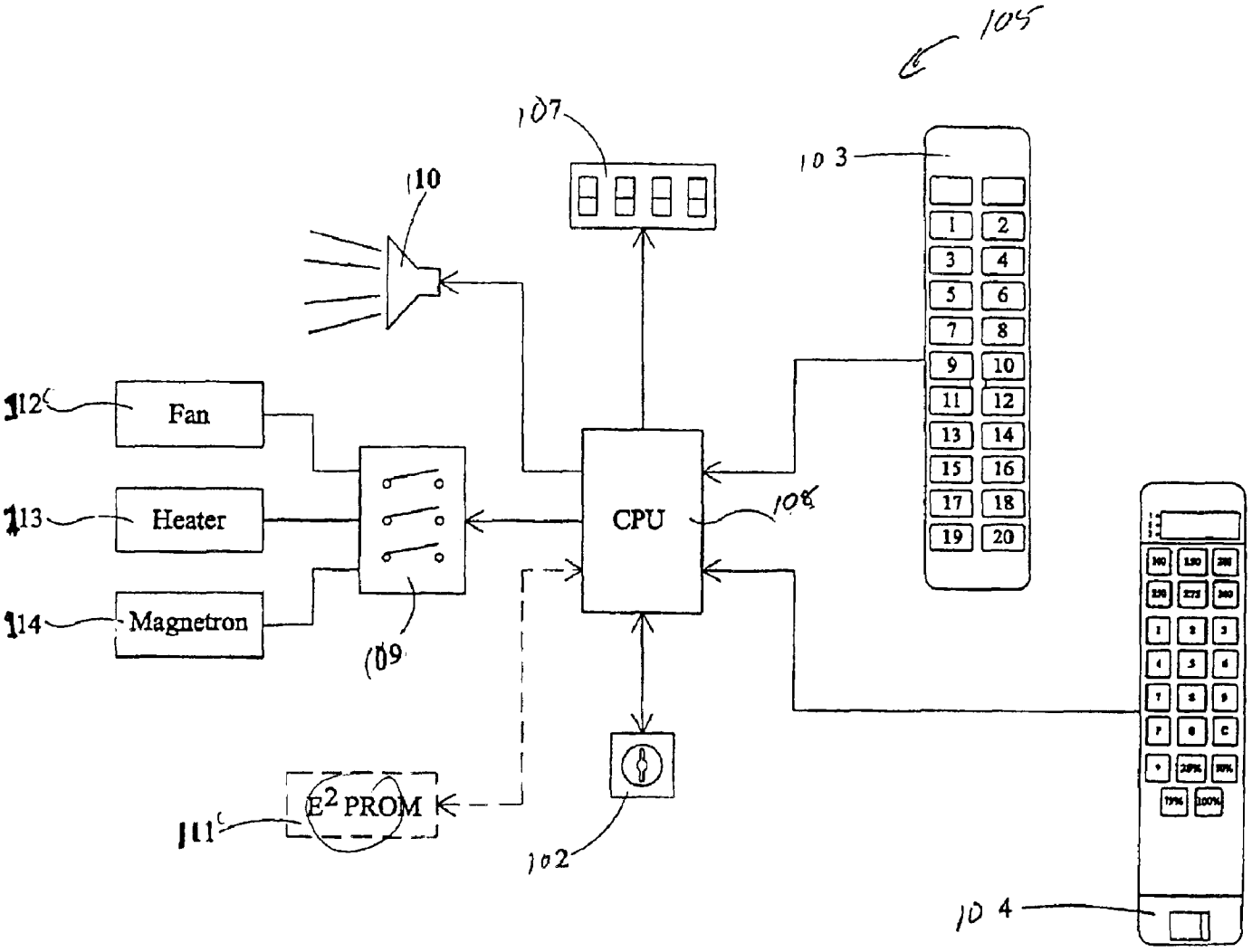
FIG. 9 is a schematic diagram showing the arrangement of components of the food service device.

Referring to FIG. 9, shows the electrical components of food service device 105 that include key reader 105, keypads 103 and 104, a CPU 108, a memory 111, a display 107, an alarm/beeper 110, a switching unit 109 and control units 112, 113 and 114. A program, not shown, is stored in memory 111 and is used by CPU 108 to control switching unit 109 and control units 112, 113 and 114 to operate food service device 105 in a desired manner. Although only three control units 112, 113 and 114 are shown, more or less are possible depending on the type of food service device 105. For example, an ice maker would include a compressor, a condenser, a water pump and various valves. A food service display may include one or more electrical heaters, a compressor, a condenser, an evaporator, a fan and various valves.

Data key 1 is provided with program data corresponding to different operating sequences of food service device 105 at a data site. Data key 1 is then sent to the food service device site for use with food service device 105, and optionally with other programmable service devices (not shown), each of which is provided with a key reader 102. Although only the food service device 105 is described here, the data key 1 may operate with each other programmable service device in similar fashion.

The programs stored in memory 111 may be organized in any suitable manner. For example, memory 111 may be divided into blocks, each of which contains a program corresponding to different types of food service devices 105 or for food service devices of the same type, which require different operating sequences. Each block may contain a plurality of programs with each program containing data for a different operational sequence comprising a number of stages. Each stage may contain data specifying time, temperature, pressure and power (or other controllable features) for that stage of the operational sequence.

Figure 10:
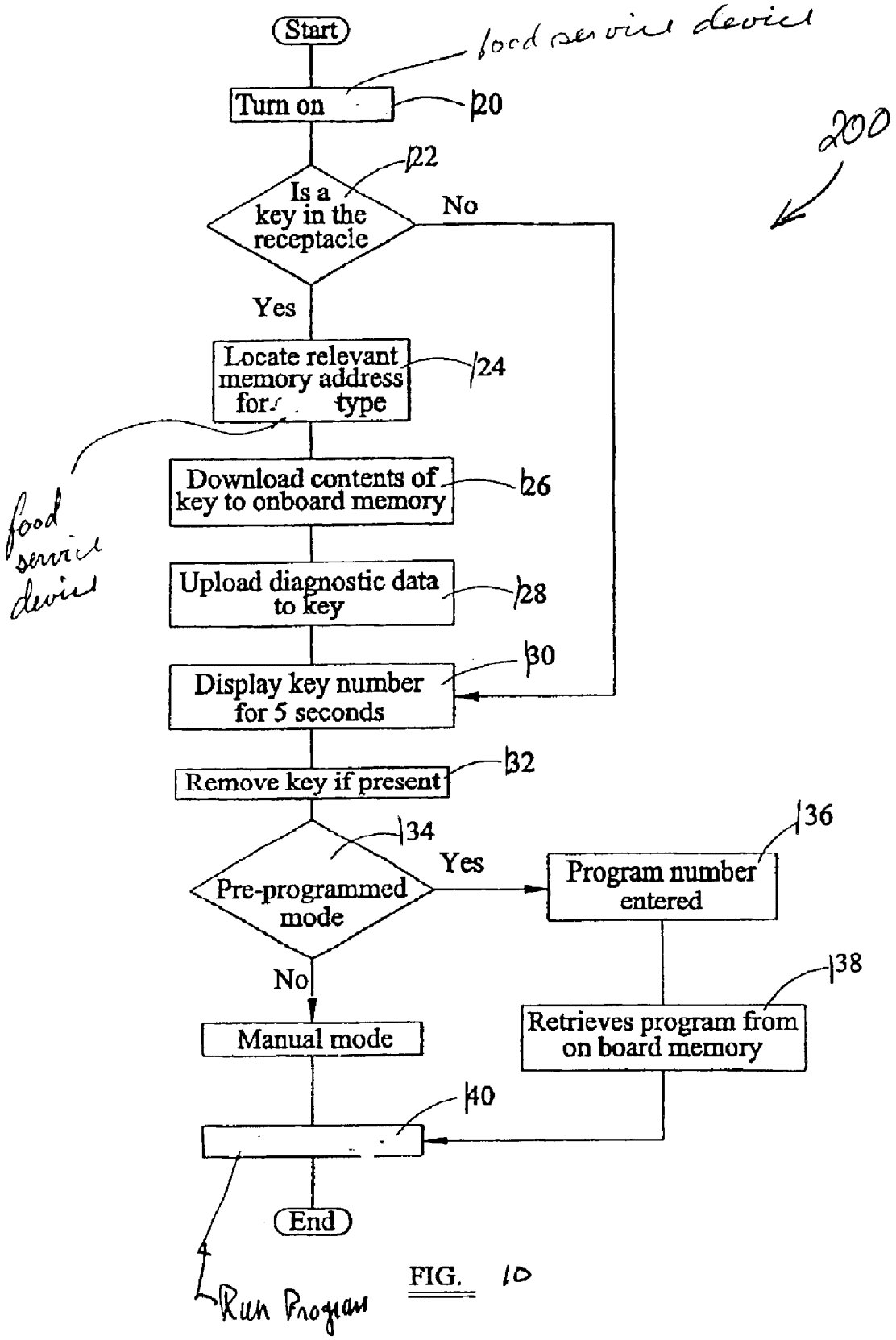
FIG. 10 shows the sequence of operations carried out in another embodiment.

Referring to FIG. 10, CPU 108 responds to a program 200 disposed in memory 111 when food service device is turned on. Step 120 detects that food service device 105 has been turned on. Step 122 determines whether a key is present in key reader 2. If a key is present, step 124 locates the address in memory 111 for the relevant block of memory on data key 1 corresponding to food service devices of the type of food service device 105.

Step 126 downloads the contents of the relevant block of program data from data key 1 to memory 111. Step 128 uploads diagnostic and operational data from memory 111 to the memory of data key 1. This data is then available for analysis when the data key 1 is returned to a data site at which data key 1 was initially programmed, or to a separate analysis site. The operational data can be any data relating to food service device 105 and/or the way in which the food service device 105 has been used. For example, the operational data may include the number of times each operational sequence has been performed by the food service device 105, the total time for which the food service device 105 has been used, the times at which the food service device 105 has been used, and so on.

Operational data can be uploaded to the data key 1 from each different programmable food service device, and stored in different parts of the memory on the data key 1.

Each data key 1 can be assigned a different key number. Step 130 displays the key number, which is read from the data key 1 by key reader 2, on display 107. For example, there may be different keys for different days of the week, or for different times of day, and the display of the key number therefore allows the user to confirm that the correct key has been inserted. The keys can be physically connected together, for example on a single ring, and can also be color coded using different colors to assist with the correct identification of each key.

If no key is present, step 22, causes display 107 to display the key number of the last data key 1 to have been inserted into key reader 2. This confirms to the user which operational sequences are currently stored in memory 111. Step 132 prompts the user, e.g., via display 107, to remove data key 1 from key reader 2. Step 34 determines whether the user has selected to operate the food service device 105 in a manual, or pre-programmed mode. If the manual mode is selected, the food service device 105 does not make use of the program data downloaded from the data key 1, and is simply operated using the manual control entered by the user via keypad 103 or and/or 104 in normal fashion.

If the user has selected the pre-program mode, then step 136 prompts the user to enter the appropriate program number using keypad 103 and/or 104. Step 138 then retrieves the program data corresponding to the appropriate operational sequence from memory 111. Step 140 then runs the program to operate food service device 105.

In an alternate embodiment, data key 1 is not removed from the food service device 105 during operation. Rather the program data is retrieved directly from the memory of the data key 1, rather than from memory 111 of food service device 105. In this embodiment use of any pre-programmed operational sequences is only available while data key 1 remains in key reader 2.

In a further embodiment of the invention, food service device 105 is programmed so that it cannot be operated at all unless a data key is present in key reader 2. This provides a useful security feature, which has applications in various areas, including hospitals, schools and institutions where unauthorized use of the food service device 105 could be hazardous.

Figure 11:
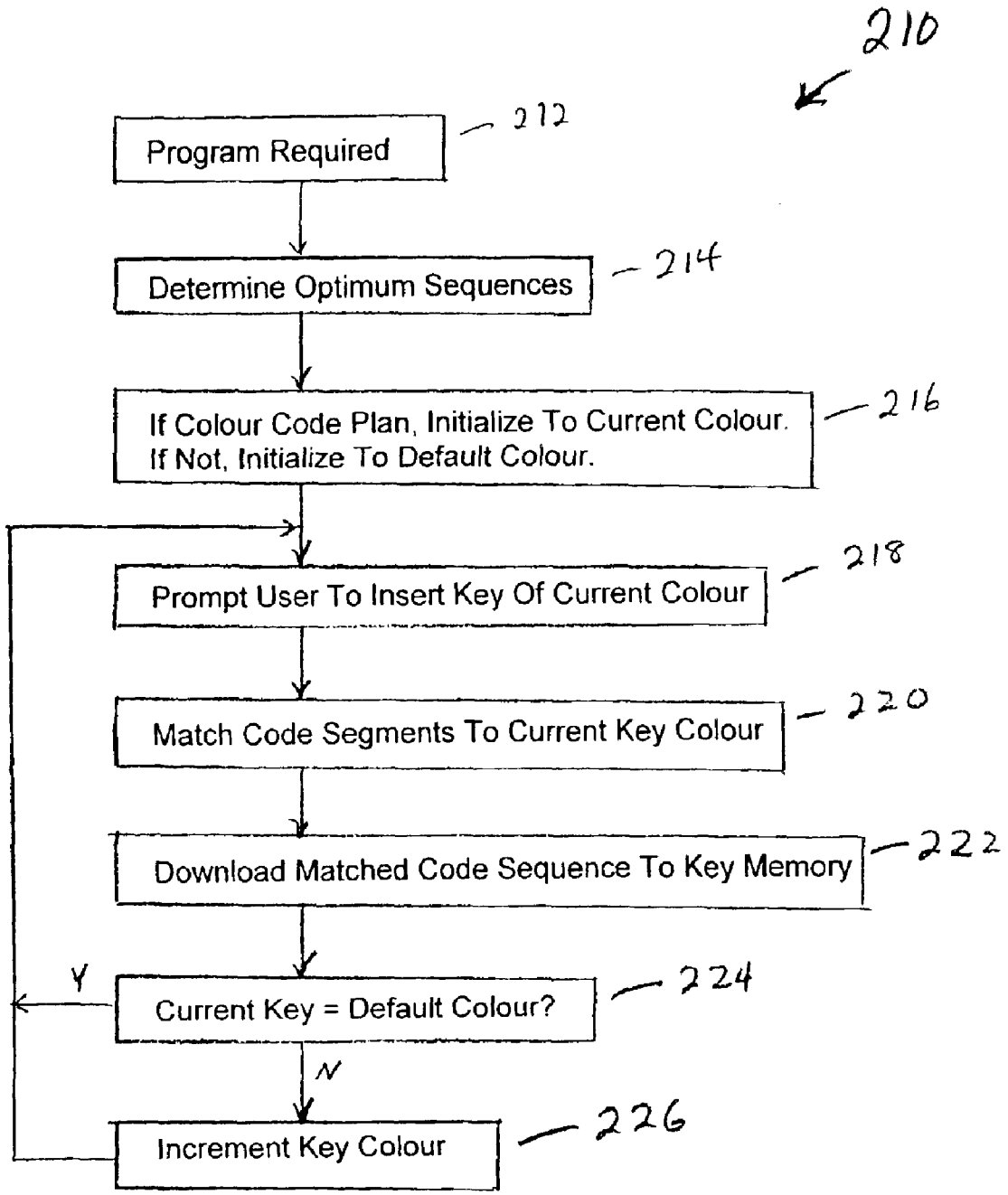
FIG. 11 shows a program for programming the keys.

Referring to FIG. 11, key 1 is programmed by a computer system that has a key reader similar to key reader 2 (FIG. 1) and a program 210. This computer system can be located at any suitable site. Program 210 at step 212 detects that a program for keys is required. For example, a request is entered via a keyboard or other input device. Step 214 determines optimum code sequences for the required key program.

Step 216 determines if a color code plan is required. The color code plan, for example, may designate that certain sequences are to be performed at certain times. For example, the certain times could be on certain days and not on others. Thus, a program for Monday could be designated as red, a program for Tuesday as blue and so on. Step 216 would then initialize the computer system to the colors of the plan and arrange them in a key color order. If there is no color plan, then step 216 initializes the computer system to a default color, which may be the normal color for the keys.

Step 218 prompts the user to insert the key of the current color. This will either be the default color or the first color of the key color order. Step 220 matches the code segments to the current key color and step 222 downloads the matched code sequences to the current key. Step 224 determines if the current key is the default color. If so, steps 218 through 224 are repeated. If not, step 226 increments the key color. Steps 218 through 226 are then repeated. When the current color count reaches the last color of the key color order, the key color count is reset to the first color of the key color order. Steps 218 through 224 or 226 are repeated until the user stops inserting keys in response to step 218, in which case step 218, at the expiration of a wait interval, causes an exit from program 210.

The programmed data keys 1 are then transported to the user site by post, courier or other facility. This embodiment of the invention is contemplated as applicable to any carrier that has a memory disposed therein and is adaptable for reading by a reader. For example, the carrier can be a key, a card or any other carrier.

Figure 2:
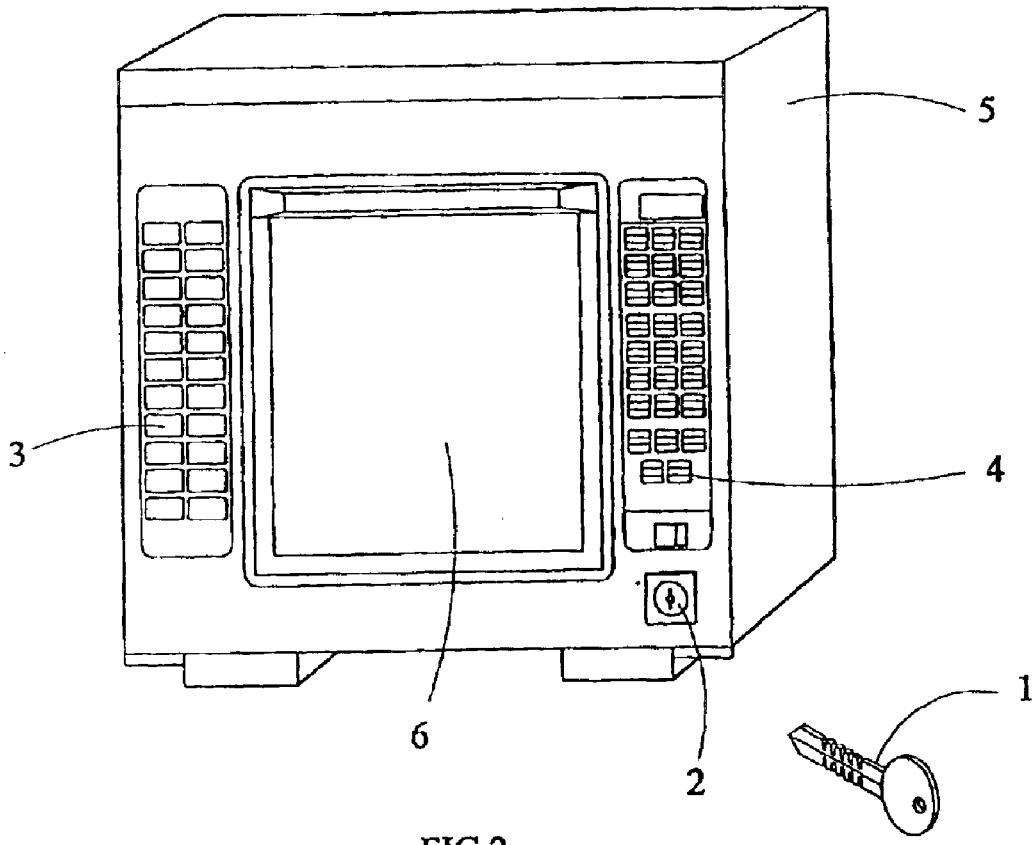
FIG. 2 shows a microwave combination oven provided with such a key aperture.

A specific example will now be described for the case of an oven, which may be a combination convection and microwave oven. Referring to FIG. 2, there is shown the key reader 2 mounted in the front panel of a microwave combination oven 5 (for example model EV2451 made and sold by Merrychef Ltd). The oven 5 is provided with a manual control panel 4, door 6, and twenty pre-program keys 3 which allow twenty preprogrammed cooking sequences to be called up at the touch of a button.

Figure 3:
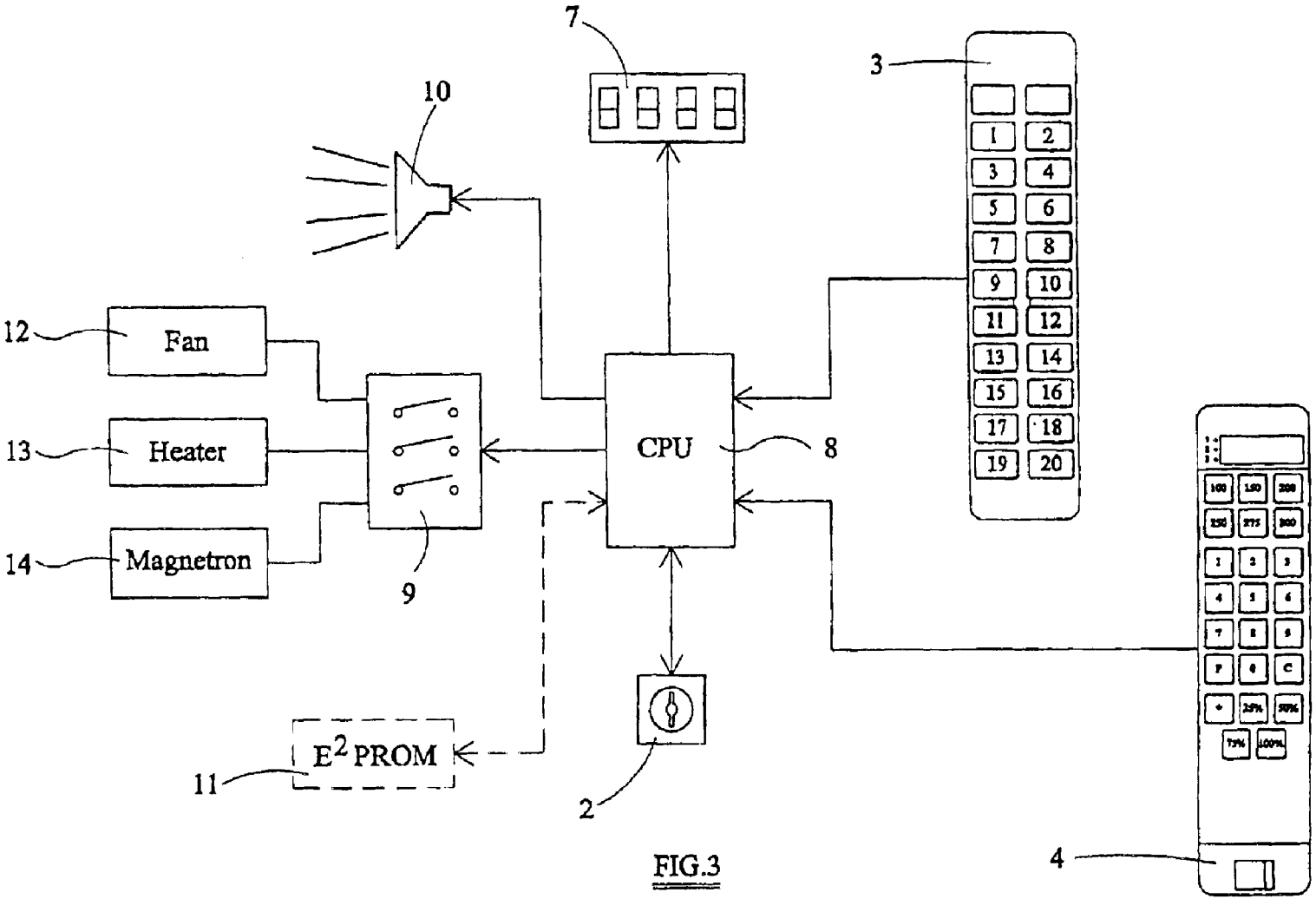
FIG. 3 is a schematic diagram showing the arrangement of components of the microwave combination oven.

FIG. 3 shows the electronic components of the oven 5, being the key reader 2, pre-program keys 3, manual control panel 4, together with a display 7, CPU (central processing unit) 8, switching unit 9, alarm/beeper 10, $E^2$PROM 11, fan 12, heater 13, and magnetron 14. The $E^2$PROM 11 exchanges data with the data key 1 via the CPU 8 in known manner.

The data key 1 is provided with program data corresponding to different cooking sequences at a data site, and is then sent to the cooking site for use with the oven 5, and with other programmable cooking devices (not shown), each of which is provided with a key reader 2. Although only the oven 5 is described here, the data key 1 operates with each other programmable cooking device in similar fashion.

FIG. 4 shows a typical arrangement of the memory of the data key 1. The memory is divided into 5 blocks, B1 to B5, each of which contains data corresponding to the cooking sequences of a different type of cooking device.

Thus, in the example the blocks B1 to B5 correspond to a microwave combination oven, a microwave oven, a conventional convection oven, a steam combination oven, and a hob respectively.

In the example of FIG. 4, each block contains three programs, P1 to P3, each containing the data for a different cooking sequence comprising a number of stages S1, S2, S3 etc. Each stage contains data specifying the time, power and temperature (or other controllable features) for that stage of the cooking sequence.

The data key 1 can be inserted into any or all of the available cooking devices in order to update the program data for that cooking device. In the example of FIG. 4 the key 1 works with any cooking device of the type corresponding to a given block of the key memory. However, further embodiments are possible in which different blocks are provided for different cooking devices of the same type. For example, a given cooking site may have a number of microwave ovens of the same type which require different program data.

Figure 5:
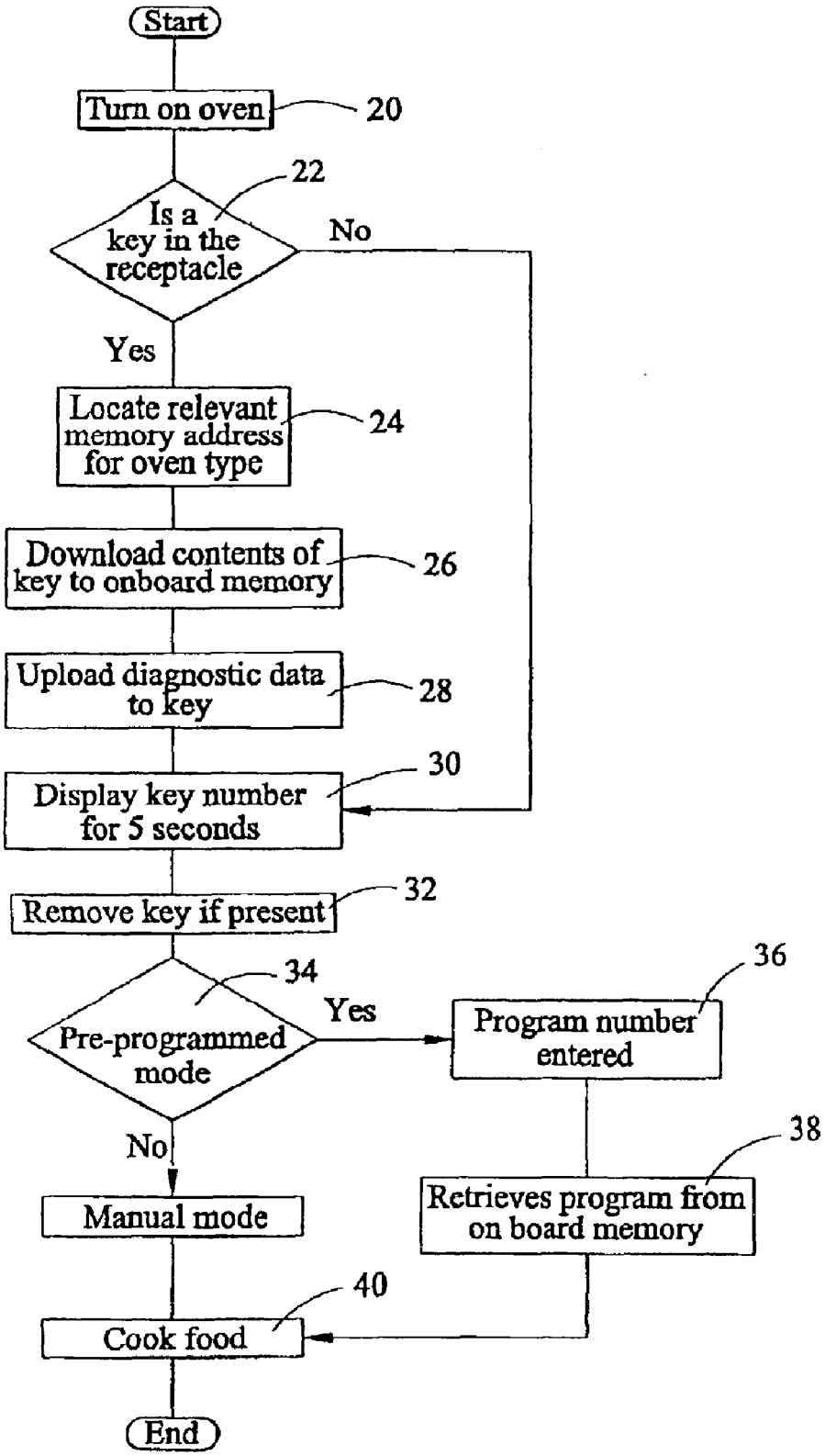
FIG. 5 shows the sequence of operations carried out in a first embodiment.

FIG. 5 shows the sequence of operations carried out by the oven 5.

In step 20 the oven 5 is turned on. In step 22 the oven 5 checks whether a key is present in the key reader 2. If a key is present, at step 24 the oven 5 locates the memory address for the relevant block B1 of memory on the data key 1 corresponding to cooking devices of the type of oven 5.

At step 26 the contents of block B1 are downloaded from the data key 1 to the $E^2$PROM 11 of oven 5.

At step 28 diagnostic and operational data is uploaded from the oven 5 to the data key 1. This data is then available for analysis when the data key 1 is returned to the data site at which the data key 1 was initially programmed, or to a separate analysis site. The operational data can be any data relating to the oven 5 and/or the way in which the oven 5 has been used. For example, the operational data may include the number of times each cooking sequence has been performed by the oven 5, the total time for which the oven 5 has been used, the times at which the oven 5 has been used, and so on.

Operational data can be uploaded to the data key 1 from each different programmable cooking device, and stored in different parts of the memory on the data key 1.

Each data key 1 can be assigned a different key number, and in step 30 the key number, which is read from the data key 1 by the key reader 2, is displayed on the display 7. For example, there may be different keys for different days of the week, or for different times of day, and the display of the key number therefore allows the chef to confirm that the correct key has been inserted. The keys can be physically connected together, for example on a single ring, and can also be color coded using different colors to assist with the correct identification of each key.

If no key is present at step 22, the display 7 displays the key number of the last data key 1 to have been inserted into key reader 2. This confirms to the user which cooking sequences are currently stored by the oven 5.

In step 32 the data key 1 is removed from the key reader 2, and in step 34 the oven 5 determines whether the user has selected to operate the oven 5 in a manual, or preprogrammed mode. If the manual mode is selected, the oven 5 does not make use of the program data downloaded from the data key 1, and is simply operated using the manual control panel 4 in normal fashion.

If the user has selected the pre-program mode, then at step 36 the user enters the appropriate program number using pre-program keys 3, and at step 38 the oven 5 then retrieves the program data corresponding to the appropriate cooking sequence from the $E^2$ PROM 11 and cooks the food at step 40.

Figure 6:
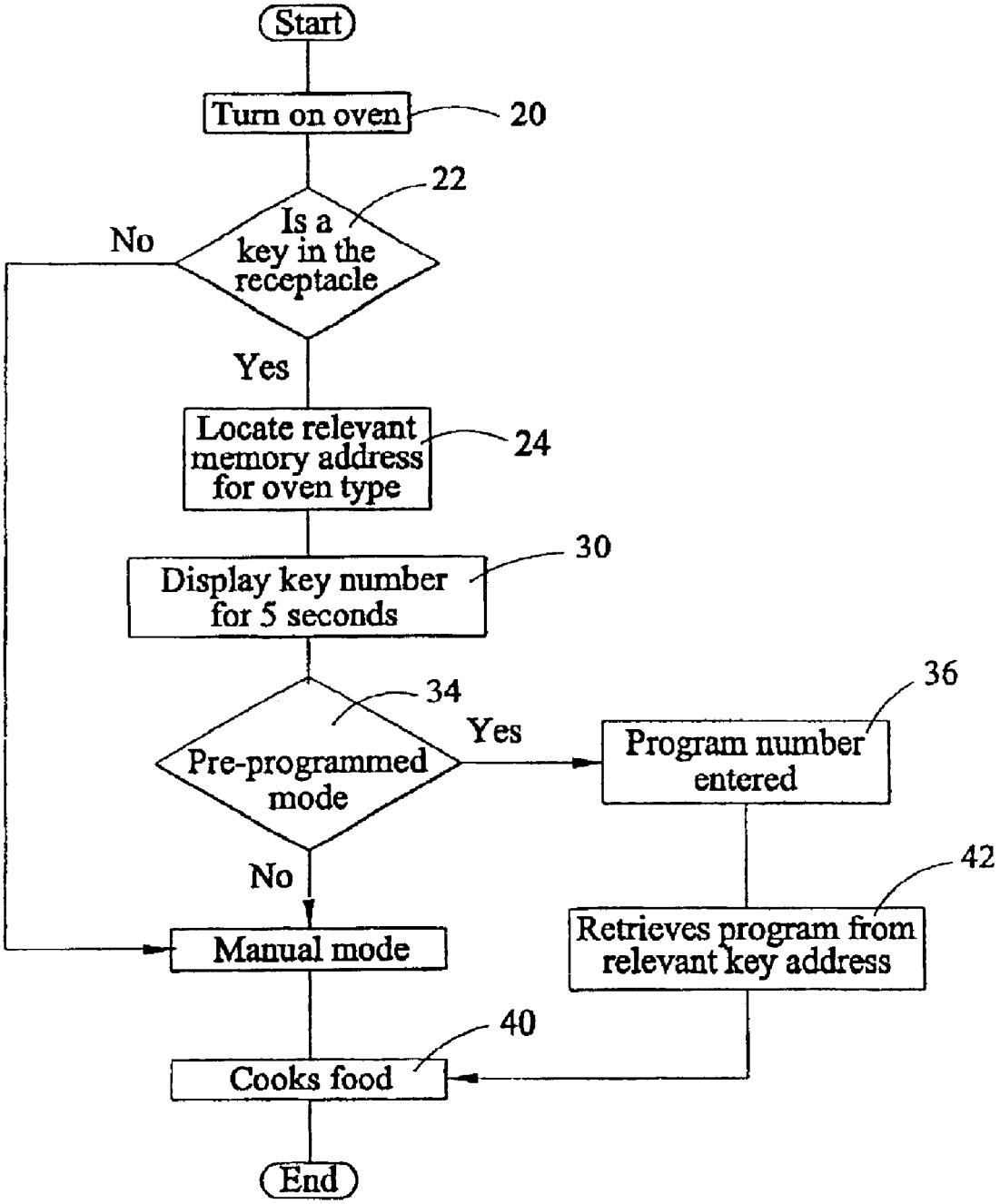
FIG. 6 shows the sequence of operations carried out in a second embodiment.

FIG. 6 shows the sequence of operations carried out by an alternative embodiment of oven 5. Steps corresponding to those in FIG. 5 are given the same reference numerals. However, in the embodiment of FIG. 6 the data key 1 is not removed from the oven 5 during operation, and at step 42 the program data is retrieved directly from the data key 1, rather than from the $E^2$ PROM 11 of the oven 5. In this embodiment use of the pre-programmed cooking sequences is only available while the data key 1 remains in the key reader 2.

In a further embodiment of the invention, the oven 5 is programmed so that it cannot be operated at all unless a data key is present in the key reader 2. This provides a useful security feature, which has applications in various areas, including hospitals, schools and institutions where unauthorized use of the oven 5 could be hazardous.

Figure 7:
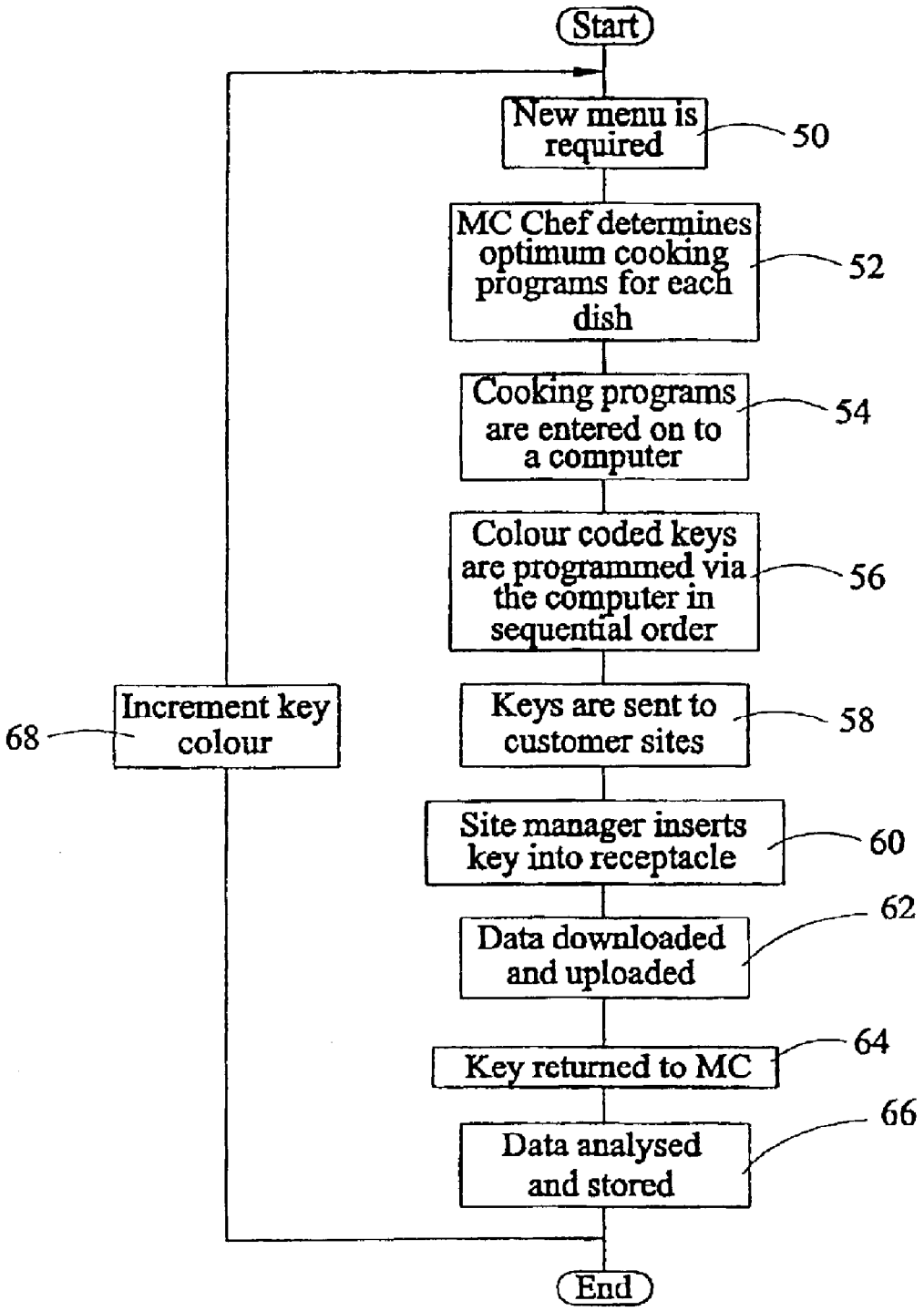
FIG. 7 shows the steps carried out in a method of operating a programmable cooking system in accordance with an embodiment of the invention.

FIG. 7 illustrates one embodiment of a method of operating a cooking system of the type described above. In FIG. 7 it is assumed that Merrychef Limited (denoted MC) acts as the data site and analysis site for a number of cooking sites.

At step 50 MC is advised that a new menu is required. MC then, at step 52 determines optimum cooking sequences or programs for each item or dish on the menu. This requires experiments to be conducted with the various items on the menu in order to determine the optimum times, temperatures and powers for each stage in the cooking sequence for each dish. These experiments are conducted for a number of different programmable cooking devices, for example the cooking devices listed in FIG. 4.

At step 54 program data corresponding to the cooking sequences is entered on to a computer according to the format shown in FIG. 4.

At step 56 the program data is downloaded to a number of differently colored data keys, the data on each key being arranged in the format of FIG. 4. It is assumed that the menu specifies that different dishes will be available on different days and at different times of day, and each key corresponds to a different time and has program data downloaded to it accordingly.

At step 58 the data keys are sent, for example, by post, from MC to each customer cooking site.

At step 60, the site manager or chef at each cooking site inserts the data keys into key readers of the programmable cooking devices at the appropriate times.

At step 62 data is downloaded from the data keys and uploaded to the data keys in the manner described above.

At step 64 each key is returned to MC, and at step 66 the uploaded data is analyzed and stored by MC. The uploaded operational data can be used to determine how many meals of each type have been cooked, and this data can be used for stock control and stock ordering purposes. The uploaded operational data can also indicate how long each cooking device has been used for. If the cooking devices are supplied by MC under warranty, such data can be used to determine whether or not the cooking devices fall within the terms of the warranty. For example, a warranty may specify that a cooking device only remains under warranty if its usage, or usage within a given period of time, falls below a certain number of hours. The operational data can also be used in a variety of other ways. For example, it sometimes happens that the cooking device which is located nearest to a given chef or cook is over-used relative to another cooking device of the same type at the cooking site. The operational data can be used to determine and correct such patterns of use.

Step 68 indicates that different colored data keys are used for the next menu for which MC prepares data keys.

What is claimed is:

1. Food service apparatus comprising:

a plurality of programmable food service devices each comprising:

a key aperture adapted to receive a key, wherein said key includes a memory containing a plurality of programs, wherein different ones of said programs exclusively operate different ones of said food service devices;

a key reader that is disposed to access said memory; and a controller that is operatively linked to said key reader and that responds exclusively to a corresponding one of said programs to operate said food service device.

2. The food service apparatus of claim 1, wherein said controller is operative to control said key reader to write operating data of said food service device to said memory.

3. The food service apparatus of claim 1, wherein said key and said key reader each include communication contacts selected from the group consisting of electrical, optical, infrared, magnetic and any combination thereof.

4. The food service apparatus of claim 1, wherein said memory includes at least first and second programs for a first one of said food service devices, and wherein said first and second programs are for different operating sequences of said first food service device.

5. The food service apparatus of claim 1, wherein said food service device is selected from the group comprising: an oven, a fryer, a food service display, an ice maker, a grill, a ventilation system, and any combination thereof.

6. The food service apparatus of claim 5, wherein said oven is selected from the group consisting of: convection, microwave, steam and any combination thereof.

7. The food service apparatus of claim 1, wherein said controller responds to said corresponding one of said programs to operate said food service device only when said key is inserted in said key aperture.

8. The food service apparatus of claim 1, wherein said controller downloads said corresponding one of said programs for operation of said food service device.

9. The food service apparatus of claim 1, further comprising a plurality of such data keys each carrying different operational sequence program data, thus allowing a user to choose which operational sequences to make available to the food service device, and to make different operational sequences available at different times.

10. The food service apparatus of claim 9, wherein different data keys are different colours, in order to provide more simple identification to a user.

11. A method of providing operational programs to a plurality of food service devices, said method comprising:

storing said operational programs in a first memory; and downloading at least one of said operational programs to a second memory located on a key that is adapted for insertion in a key apertures that are disposed in said food service devices, wherein different ones of said programs exclusively operate different ones of said food service devices.

12. A method of operating a plurality of food service devices comprising:

providing a key aperture in each of said food service devices;

inserting a key in said key aperture of a first one of said food service devices, said key having a memory that stores a plurality of programs, wherein different ones of said programs exclusively operate different ones of said food service devices; and using a corresponding one of said programs to exclusively operate said first food service device.

13. The method of claim 12, further comprising the step of a data writer of first food service device writing to the memory of said key operational data relating to the operation of said first food service device.

14. The method of claim 13, wherein said operational data includes data representing the total time for which the food service device has been used since a given point in time.

15. The method of claim 14, wherein said operational data representing the total time for which the food service device has been used is analyzed in order to provide usage information, and said usage information is used to determine whether the food service device falls within the terms of a warranty on the food service device provided by a supplier to the food service device user.

16. A method of operating a food service device, said method comprising:

providing a plurality of carrier devices, each having a memory that stores a program, each of said programs being different, each of said carrier devices having a different colour according to a plan of operating said food service device; and inserting said carrier devices in a reader disposed in said food service device to operate said food service device with said different programs according to said plan.

17. The method of claim 16, wherein said carrier devices are selected from the group consisting of: key, card, and any combination thereof.

18. The method of claim 16, wherein said colours correspond to different times, and wherein said food service device is operated according to said plan when said carrier devices are inserted into said reader at said different times corresponding to said colours.

19. The method of claim 16, wherein said food service device is selected from the group consisting of: an oven, a fryer, a food service display, an ice maker, a grill, a ventilation system, and any combination thereof.

20. The food service apparatus of claim 19, wherein said oven is selected from the group consisting of: convection, microwave, steam and any combination thereof.

* * * * *